United States Patent [19]

Frolov

[11] 4,122,294

[45] Oct. 24, 1978

[54] METHOD OF AND DEVICE FOR FORMING SELF-BAKING ELECTRODE

[76] Inventor: Jury Fedorovich Frolov, M. Muranouskaya ulitsa, 11, korpus 1, kv. 29, Moscow, U.S.S.R.

[21] Appl. No.: 755,041

[22] Filed: Dec. 28, 1976

[51] Int. Cl.[2] ..... H05B 7/09

[52] U.S. Cl. ..... 13/18 R

[58] Field of Search ..... 13/18; 313/327

[56] References Cited

U.S. PATENT DOCUMENTS

| | | | |
|---|---|---|---|
| 1,442,033 | 1/1923 | Sem et al. | 13/18 |
| 3,524,004 | 8/1970 | Van Nostran et al. | 13/18 X |
| 3,619,465 | 11/1971 | Cavigli | 13/18 |
| 3,624,261 | 11/1971 | Cavigli | 13/18 |

*Primary Examiner*—R. N. Envall, Jr.

*Attorney, Agent, or Firm*—Lackenbach, Lilling & Siegel

[57] ABSTRACT

The method of forming a self-baking electrode consists of filling an electrode mass under pressure into a permanent current-carrying shell during melting in an electric furnace. The electrode mass is fed, according to the invention, in compliance with data obtained by continuous measuring of the temperature of the electrode being formed at several points along its height and in its cross-section, at a rate which is proportional to that of the electrode coking, shifting and burning-off.

The device for realizing said method, comprises a charge-loading passage which is made in the form of a pipe, a permanent current-carrying mould communicating with a mass-feeding passage having presses fitted over it, an electrode drive mechanism and thermoelements for measuring the temperature of an electrode being shaped. According to the invention, the mass-feeding passage is formed by pipes arranged around said charge-loading pipe and secured to said electrode drive mechanism, said mass-feeding pipes each accommodating an individual press.

8 Claims, 9 Drawing Figures

METHOD OF AND DEVICE FOR FORMING SELF-BAKING ELECTRODE

FIELD OF THE INVENTION

The present invention relates to electrothermics and, more particularly, to a method of forming a self-baking electrode and a device for effecting same. It is most advantageous in ferrous and nonferrous metallurgy, chemistry and other industries using electric furnaces with self-baking electrodes.

Further progress of ore electrothermics is closely associated with the problem of developing advanced types of electric furnace equipment and simultaneously improved methods of operation thereof, which insure higher productivity, cut down the net cost and improve the occupational health conditions of service personnel.

DESCRIPTION OF THE PRIOR ART

Known in the prior art is a method of forming a continuous self-baking solid- or hollow Søderberg electrode, wherein an electrode mass is filled into a metallic casing where it undergoes a process of gradual transformation into four aggregate states as the electrode is being baked.

Thus, in the top part of the electrode the charged electrode mass (at a temperature of 0° to +70° C.) is present in the form of separate solid lumps or aggregates. In the underlying layer (at a temperature of from +70° C. to +360° C.) the electrode mass changes gradually into the next aggregate state and becomes pasty. Next at the entry of and in the electric-contact unit zone proper (at a temperature varying within +360°–+400° C.), the electrode mass changes from a liquid state into a non-plastic state (a coking zone). Further on, in the lower part of the electric-contact unit (at a temperature of from +400° to +500° C.), the mass reaches its baking stage and changes into a solid and forms a solid electrode structure. Characteristic of the sintered electrode mass is a sharp reduction in electrical resistance along with an abrupt increase in its electric conductivity. With the roasting process of the self-baking Søderberg electrode proceeding normally, mass feeding, required for continuous forming of an electrode to compensate for its burning-off, is effected together with the metallic casing by means of special devices holding and shifting the casing with the mass (i.e. the electrode as a whole). These three processes — consuming (burning-off), roasting and shifting of the electrode to make up for its burning-off — are carried out independently. In the ideal case with the Søderberg electrode all the three processes must proceed at the same time and be stable.

However, owing to a number of causes pertaining to variations (disturbances) in the course of the production process and caused, for example, by changes in the composition of raw materials, by charge proportioning etc., by electrical characteristics of the furnace owing, e.g., to fluctuations in bath resistance, variations in the quality of an electrode mass and its nonuniform structure (i.e., nonuniform distribution of its constituents), imperfect design of an electric-contact unit and devices for mechanical shifting of the electrode, as well as those caused by the skin and "proximity" effects, when using the now-existing method of forming a self-baking electrode, these processes are not accomplished simultaneously and lack stability. Various attempts at improving the above-outlined method result, at best, in two of the three processes being effected at the same time, e.g., that of burning-off the electrode and its lowering to compensate for its burning-off, the roasting process not being, however, accomplished simultaneously with the above processes.

The asynchronous and unstable nature of these processes leads to the following serious disadvantages peculiar to the now-existing method of forming a continuous self-baking Søderberg electrode.

If the burning-off process precedes the roasting process and is in step with the shifting of the electrode to compensate for its burning-off, the electrode coking zone drops down below the level of the electric-contact unit jaws and an electric current flows only through the metallic casing (the liquid electrode mass being actually non-conductive) with a quite real risk of "wet" breakage of the electrode and of the electrode mass flowing out thereof.

If, on the other hand, the burning-off of the electrode proceeds at a lower rate than roasting, the process of shifting the electrode to make up for its burning-off, carried out in step with the first process, fails to prevent the electrode coking zone from rising above its optimum level or above the top edge of the electric-contact unit jaws. As a result, an over coked part of the electrode will crumble and a "dry" breakage will follow.

With the present-art method of forming an electrode a certain quite possible combination of the above processes may lead to a situation where electrode burning-off and its roasting are effected sufficiently simultaneously, the process of shifting the electrode (its lowering to offset burning-off) however, is not accomplished in step.

The above phenomenon is encountered rather frequently, even now, both when using Wisdom's brakes and now in use mechanisms adapted for holding and shifting the electrode and comprising two brake rings, and with the slipping of electrodes which takes place in practice regardless of the design of said shifting mechanism.

On any of the above-outlined occasions the breakage of an electrode causes a higher consumption of an electrode mass and electric energy, increases furnace downtime and lowers furnace efficiency.

Known as well in the art is a number of devices for forming a solid- or hollow self-baking electrode.

Thus, a prior-art device for forming a self-baking electrode comprises a charge-loading pipe, a permanent current-carrying mould of a hollow self-baking electrode, communicating with a mass-feeding passage fitted over with presses, and an electrode drive mechanism.

The permanent current-carrying mould is a double-wall die with an opening facing the furnace interior, said die being secured together with a current lead to a supporting casing which is in extension of the electrode being formed and is coupled by its top part with the electrode drive unit. To enable continuous forming of an electrode and its discharge from the mould, the top part of the permanent current-carrying mould is fitted with openings for feeding a thin electrode mass and with a feedstock means in the form of an annular piston cylinder. To reduce the length of the current lead a current-distribution attached to the supporting casing is mounted above the permanent current-carrying mould.

However, characteristic of said device for forming a self-baking electrode is a highly sophisticated construction, a need for using only a thin mass which is introduced directly into current-carrying mould. Moreover, it fails to ensure an adequate pressure on the electrode mass through which an electrode structure has a lower density during its baking.

The disadvantage of the above device revealed in forming a hollow self-baking electrode resides in that it does not afford the possibility of displacement of the charge-loading pipe which is adapted for defining a central opening in the electrode, a feature which, on the one hand, diminishes service life and reliability of said pipe and, on the other hand, may, in case of pipe burning with the ensuing disturbance of the production process and electrode coking conditions, deteriorate the integrity of a hollow self-baking electrode both along its height and in the cross-section, with the electrode mass flowing out thereof. This may adversely affect the quality of the electrode and lead to a sharp increase in its consumption or cause its breakage.

The above phenomena results in additional consumption of electric energy and electrode mass and in a lower electric furnace efficiency.

SUMMARY OF THE INVENTION

The main object of the present invention is the provision of simultaneous and stable processes of roasting, burning-off of an electrode and shifting the electrode to compensate for its burning-off.

Another object of the invention is to improve the quality of the electrode.

Still another object of the invention is to reduce the electrode mass and the electric power consumption.

Yet another object of the present invention is to provide a higher efficiency of the electrode forming process.

A further object of the invention is to preclude irregular roasting and shifting of the electrode to compensate for its burning-off and its nonuniform burning-off both along height and in the cross-section, for instance, due to the skin and proximity effects.

These and other objects are achieved by a method of forming a self-baking electrode, according to the invention, consisting of filling an electrode mass into a current-carrying mould, in compliance with data obtained by continuous measuring of the temperature of the electrode being formed at several points along its height and in the cross-section thereof, at a rate which is proportional to that of electrode, coking, shifting and burning-off.

To preclude irregular roasting of the electrode mass, it is advisable that the mass be fed into the coking zone by alternating its operation mode.

It is also good practice that fluxing and/or alloy additives be introduced into the electrode mass while forming a self-baking electrode.

A device for realizing said method of forming a self-baking electrode, comprises a charge-loading means, e.g., a pipe, a permanent current-carrying mould for shaping a self-baking electrode, communicating with a mass-feeding passage having presses fitted over it, an electrode drive mechanism and thermoelements for measuring the temperature of the electrode being formed, according to the invention, the mass-feeding passage is defined by pipes arranged around said charge-loading pipe and fastened to he electrode drive mechanism, said pipes each accomodating a press.

For use as said thermoelements, it is preferable that temperature-sensitive elements embedded in the electrode mass should be employed.

For forming a hollow self-baking electrode it is preferable that the charge-loading pipe be furnished with an individual drive means associated with the temperature-sensitive elements mounted on said pipe.

For use as said individual drive means, use may be made of a screw jack provided with an electromechanical drive mechanism.

To improve the quality of the electrode being formed and to provide more stable furnace operating conditions, the herein-proposed device is preferably equipped with a programming control unit whose input must be coupled with said temperature-sensitive elements and whose output is coupled with the presses.

To enable dependable and trouble-free operation of the permanent current-carrying mould adapted for forming a self-baking electrode, it is preferable that a connecting ring be fastened to the mass-feeding pipes. The ring has connected to it by means of a lock joint, water-cooled electric contact elements made in the form of plates. The plates are also in a lock joint arrangement, said (plates) being detachably interconnected.

The bottom part of said charge-loading pipe can be cooled by fitting it with internal conduits for the passage of a water-air mixture and with a means for adjusting its flowrate.

It is of value if an insulating guide sleeve acting at the same time as a packing is mounted and secured in the passage for said charge-loading pipe.

The current-carrying mould can be furnished with feelers inserted periodically inside said mould in the electrode coking zone through insulating packings set up in the connecting ring at several points along the circumference and in the cross-section of the electrode.

As compared with the best achievements in this field, the herein-proposed method of and device for forming a self-baking electrode assure:

(a) up to a 70% reduction in electric energy consumption;
(b) at least a 30% reduction in electrode mass requirements;
(c) up to 20–25% of fine charge fractions, including those in a 10 mm range; and
(d) efficient waste-heat recovery of exhaust gases.

BRIEF DESCRIPTION OF THE DRAWINGS

The nature of the invention will be clear from the following detailed description of a method of and particular embodiments of a device for forming a self-baking electrode, to be had in conjunction with the accompanying drawings, in which.

The herein-proposed method of forming a self-baking electrode consists of the following. An electrode mass is filled into a mass-feeding passage and is then squeezed into a permanent current-carrying mould, wherein the electrode mass undergoes coking and is transformed into a solid structure under the effect of an electric current (Joule heat) and the heat absorbed along the electrode, due to its heat conductivity, from a furnace hearth.

The mass pressure within said current-carrying mould is developed, firstly, owing to the relatively negligible weight of the mass columns in the mass-feeding passage and, secondly, due to a considerable positive pressure exerted on the electrode mass by pressing. According to a well-known law of physics, the same positive pressure is exerted on the electrode mass in a coking zone in all the directions within the permanent current-carrying mould which, on the one hand, promotes the production of a dense and quality electrode, and, on the other hand, is a major factor in ensuring the forcing (shifting) of said electrode out of the mould as it is being coked and burnt.

As to the feeding of the electrode mass into the current-carrying shell, it is carried, in accordance with data obtainable by continuous measurement of the temperature of the electrode being formed at several points along its height and in the cross-section thereof, at a rate which is proportional to that of electrode coking, shifting and burning-off.

For uniform baking of the mass both along the electrode height and over its cross-section at a certain instant, a command signal is delivered to simultaneously start all presses compacting the electrode paste.

In the event of irregular baking of the mass within the current-carrying mould along the electrode height and over its cross-section, e.g., in a three-phase three-electrode system, with the electrodes being located at the apexes of an equilateral triangle, due to the skin and proximity effects, a command signal is generated at a given moment for putting individual presses into operation in a selective mode.

With the above-outlined method, alloy and/or fluxing additives can be introduced through the central part of the electrode being formed. Thus, melt alloyage and its refining, as well as bringing the chemical composition of the resultant products to a preset value, can be effected simultaneously with the melting of material, thereby assuring a lower consumption of the alloying elements by reducing their losses by burning.

Industrial effectiveness of the proposed method is preconditioned by a need for introducing into industry electric furnaces furnished with devices for forming solid- and hollow-electrodes without casings, such as, calcium carbide or ferro-alloy electric furnaces, as well as those adapted for production processes where the iron casing of a conventional self-baking electrode will damage the quality of a final product, e.g., aluminium-silicon, silicon, metal manganese, etc.

Figure 1:
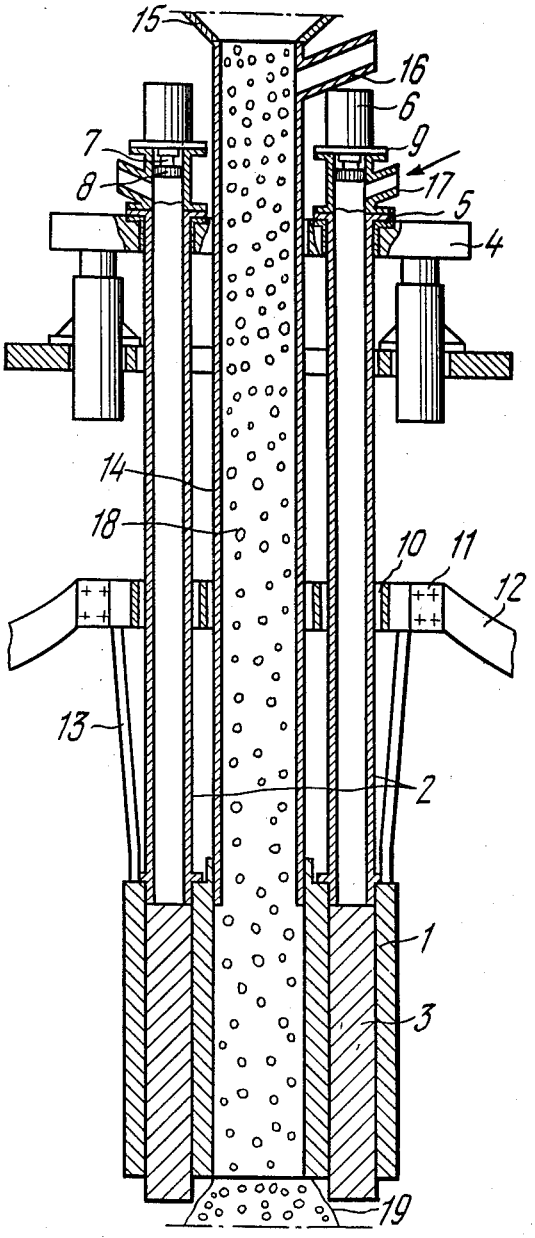
FIG. 1 is a longitudinal, cross sectional view of a device for forming a self-baking electrode, according to the invention.

According to the preferable embodiment of a device for carrying into effect the above-outlined method of forming a self-baking electrode, shown in FIG. 1, the device comprises a permanent current-carrying mould 1 communicating with a mass-feeding passage formed by pipes 2. Depending on the size of the formed electrode 3 three, four or more pipes 2 may be used. In case three pipes 2 are employed, they are arranged at an angle of 120° with respect to each other (at the apexes of an equilateral triangle); if a four-pipe system is used, the pipes 2 are located at an angle of 90° (at the apexes of a square). Similarly, other multipipe systems have the pipes equally spaced. At their top the mass-feeding pipes 2 are coupled by means of electrical insulation 5 to a drive means 4 for shifting an electrode 3. Fastened to the top part of each mass-feeding pipe 2 are presses 6, each of which having a connecting rod 7 and a piston 8. The presses are coupled with the mass-feeding pipes 2 by means of electrical insulation 9. The current distribution ring 11 of a current lead 12 is coupled to the mass-feeding pipes 2 with electrical and heat insulation 10, said ring 11 being connected by a water-cooled tubular busbar 13 to the current-carrying mould 1. The device also comprises a charge-loading pipe 14 around which the mass-feeding pipes 2 are arranged and whose bottom part is in communication with the current-carrying mould 1. At its top the pipe 14 is insulated electrically and secured to the drive means 4 for shifting the electrode 3; it is also coupled with a hopper 15 and fitted with a gas offtake 16.

To decrease electric losses in the metal structures, the sections of the mass-feeding pipes 2 and the charge-loading pipe 14 positioned near the current-carrying elements, namely the current distribution ring 11, the current lead 12 and the water-cooled tubular busbar 13, are made of materials with a low permeability, e.g., nonmagnetic steel.

The herein-proposed device operates in the following manner.

The electrode mass (in a solid or liquid state) is fed through branch pipes 17 of each press 6 in a known manner (e.g., through pipelines, vibration hoses, by screw conveyors, etc.) from a the hopper (not shown in the drawing) first into the mass-feeding pipes 2 and then to the permanent current-carrying mould 1, where under the effect of an electric current and heat inflow from a furnace hearth (bath) the hollow electrode 3 is formed and baked. The electric current flows into the current-carrying mould 1 through the water-cooled tubular busbars 13 from the current distribution ring 11 of the current lead 12, which is coupled with a furnace power supply (not shown in the drawing).

Under the effect of compressed air or pressurized liquid the presses 6, acting simultaneously or individually after a certain period of time, compact the electrode mass, forcing it gradually out of the mass-feeding pipes 2 into the permanent current-carrying mould 1. The presses are controlled by a manual or an automatic control system. The constant pressure of the electrode mass is sustained due to the height or amount of it in the mass-feeding pipes 2. Under the pressure of the electrode mass the baked hollow electrode 3 is squeezed out of said current-carrying mould 1. Charged particles 18 pass from the hopper 15 along the charge-loading pipe 14 into a furnace hearth 19 (bath) directly under electric arcs, that are arcing on the end face of said hollow electrode 3. A hot gas travels up from the furnace hearth 19 along the charge-feed pipe 14, transmits a considerable part of its heat to the charge 18, and escapes through the gas offtake 16.

The gas can flow in an opposite direction through the same charge-loading pipe 14; if such is the case, use may be made of a gas being collected from the electric furnace (e.g., from the gas offtake in a furnace roof) or of some other gas (for instance, natural or inert ones).

The entire device with the hollow electrode 3 is transferred under the effect of an automatic power controller (not shown in FIG. 1) by means of the drive means 4 for shifting an electrode 3, said drive means being either of the hydraulic (as shown in the drawing) or, e.g., electromechanical — a screw or a rope winch — or of some other type. In forming the electrode 3 the temperature of the electrode mass within the current-carrying mould 1 is monitored by temperature-sensitive elements or feelers (not shown in FIG. 1).

Figure 2:
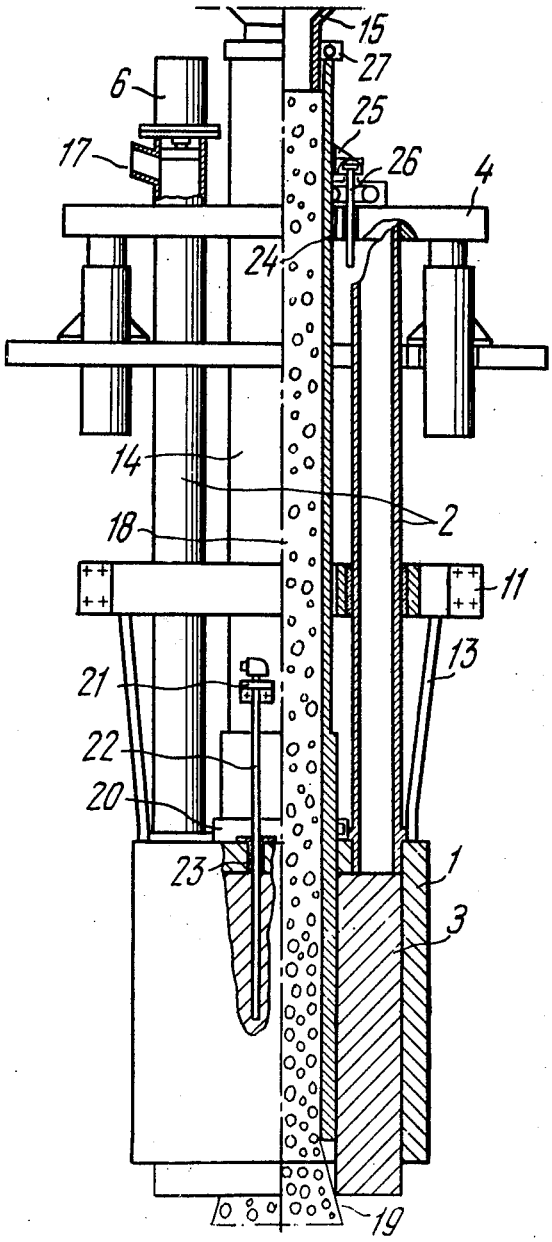
FIG. 2 is a longitudinal partly in section, view of another embodiment of a device for forming a self-baking hollow electrode, according to the invention.

Another embodiment of the proposed device, presented in FIG. 2, comprises a permanent current-carrying mould 1 for producing a hollow self-baking electrode 3, mass-feeding pipes 2 having lower portions communicating with said current-carrying mould 1 and top portion interconnected with a drive means 4 for shifting an electrode 3.

The top part of the mass-feeding pipes 2 has presses 6 secured to it.

A charge-loading pipe 14, forming an inner wall of the current-carrying mold 1, is inserted thereinto with an insulating packing 20 set up on said current-carrying mould 1.

Secured to the charge-loading pipe 14 along its circumference are temperature-sensitive elements 22 set up on brackets 21 and inserted into the electrode coking zone within the current-carrying mould 1 with insulating packings 23 at several points along the height and in the cross-section of the self-baking electrode 3 being formed.

The top part of said charge-loading pipe 14 passes through an insulating guide sleeve 24 built in the drive means 4 for shifting an electrode 3 and is interconnected therewith by brackets 25 by means of screw jacks 26.

Depending on the adopted production process, either the entire charge-loading pipe 14 is made of a high-temperature wear-resistant material, such as, steel, titanium, etc., or only its bottom portion introduced into the current-carrying mould 1 is fabricated of said materials.

In the latter case, the top portion of said charge-loading pipe 14 is manufactured of an acid-fast material, e.g., steel, etc. The bottom part of the charge-loading pipe 14 may be a detachable water-cooled casting body made, for example, of iron with a cast-in steel coil.

At its top the pipe 14 terminates with an electrically insulated packing 27 secured thereto and ensuring a sealed telescopic connection with the branch pipe of a loading hopper 15.

The number of screw jacks 26 is dictated by the dimensions of the charge-loading pipe 14 or, to be more precise, by those of the hollow self-baking electrode 3, but in any case at least two screw jacks 26 must be used. The screw jacks 26 can be operated either by hand or automatically with the aid of a controllable drive mechanism, e.g., by means of an electric motor or a motorized reducer.

As to the number of temperature-sensitive elements 22 and their arrangement, these are determined by the dimensions of the hollow self-baking electrode.

The above-outlined device functions in the following manner.

Figure 9:
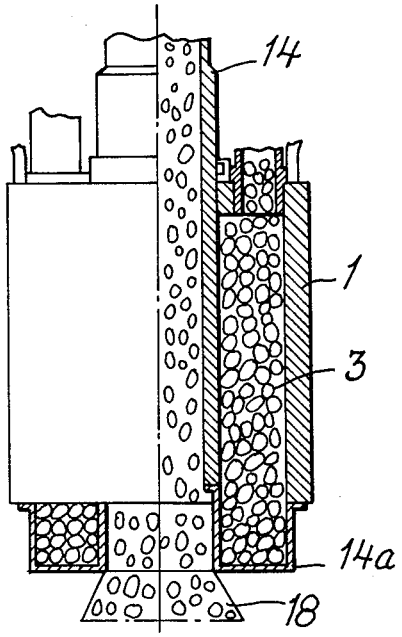
FIG. 9 is a longitudinal, partly in section, view of the embodiment shown in FIG. 2, when the stopper is in contact with the bottom edge of the mold.

First, the charge-loading pipe 14 is brought by the screw jacks 26 into an extreme bottom position (see FIG. 1) so as to provide free access for attaching thereto in a known manner, e.g., by welding, a temporary mushroom stopper or plug 14*a* made of a sheet material, e.g. steel. Next, the charge-loading pipe 14 is hoisted by the screw jacks 26 until the mushroom stopper 14*a* is in contact with the plane of the bottom edge of the current-carrying mould 1 (see FIG. 9) thereby defining an annular cavity between the charge-loading pipe 14 and the current-carrying mould 1, said cavity being closed from beneath by said stopper 14*a* and adapted for forming a hollow self-baking electrode 3.

Next the drive means 4 for shifting the electrode 3 moves the device down so as to provide a 150–200 mm spacing between the mushroom stopper 14*a* (and hence between the end face of the current-carrying mould 1) and the furnace hearth.

Following that, the first preset batch of charged particles 18 which are of a current-conducting carbonaceous material, e.g., coke, is fed from the loading hopper 15 along the charge-loading pipe 14 under the bottom end face of a future hollow self-baking electrode 3, thereby closing the space between adjacent electrodes mounted inside the furnace and making a circuit for the subsequent passage of an electric current.

After that, an electrode mass is loaded into the mass-feeding pipes 2 by resorting to a known means, such as, screw feeders or vibration hoses, filling to capacity the entire volume intended therefore (the annular cavity of a future hollow self-baking electrode 3 and the mass-feeding pipes 2). Next, the presses 6 are put into operation and the electrode mass undergoes precompression and is compacted (pressed). Further, when operating under steady-state conditions, the presses 6 are not only pressing the electrode mass in the electrode coking zone, but also force out the baked electrode 3. A power supply is turned on in and an electric current starts flowing the tubular busbars 13, the current-carrying mould 1, the mushroom stopper 14*a* and the coke in the thus made circuit. As a result, the mishroom stopper 14*a*, the coke and the electrode mass are heated, which leads to the gradual creation of the temperature conditions required for forming a hollow self-baking electrode 3.

Upon attaining an electrode coking temperature (350° – 400° C.), the electrode mass, beginning from the electrode end face and extending upwards across its section, undergoes transformation into a new aggregate state forming a solid electrically conductive structure. By that moment, the mushroom stopper 14*a* burns to ashes having performed its function, and the screw jacks 26 move the charge-loading pipe 14, according to the readings of the temperature-sensitive elements 22 carried therewith, into a certain position inside the current-carrying mould 1, thus assuring the manufacture of a high-quality hollow self-baking electrode 3.

With a steady-state production process the electrode mass as well as the charge of a preset composition are fed continuously.

The gas liberated in the furnace hearth rises along the charge-loading pipe 14 giving up its heat to the charged particles 18 and being discharged through a gas offtake 16.

In this embodiment gas supply in an opposite direction (downwards) through the charge-loading pipe 14 and charged particles 18 is also possible, which allows utilization of either collected waste furnace gases (e.g., drawn off through the gas offtake in a furnace roof) or some other gas.

With the production process as a whole and the coking operation proceeding under normal conditions and with the hollow self-baking electrode 3 being shifted to compensate for its burning-off, the charge-loading pipe 14 (for a given electrode mass brand featuring certain physicomechanical properties) maintains a constant optimum position within the current-carrying mould 1.

In case of a variations in the course of technological process and disturbances of normal electrode-forming conditions, two versions can be employed for shifting the charge-loading pipe 14. The selection of a version depends on the electrode size, the quality of the electrode mass, the type of furnace and the nature of the technological process.

According to the first version, the temperature in the coking zone of a hollow self-baking electrode 3 (ranging within 350° - 400° C.) is measured by temperature-sensitive elements 22 whose readings are transmitted to an indicating or recording instrument, e.g., a potentiometer (not shown in FIG. 2). which is accompanied, for example, by a light or audio signal being sent to an operator actuating manually the screw jacks 26 to move the charge-loading pipe 14.

According to the second version, the readings of said temperature-sensitive elements 22 are transmitted to a pre-adjusted instrument (e.g., of the potentiometer type) or an integrated-circuit programming unit (not shown on FIG. 2) which transmits a command signal to the drives of said screw jacks 26 for automatic hoisting or lowering of the charge-loading pipe 14 to set it to the requisite position.

When, for example, a programming unit based on an integrated circuit is employed, it adds the readings of all the temperature-sensitive elements 26 with the command signal for cutting-in the drive mechanisms of said screw jacks 26 being produced only when the upper or lower limit of the temperature in the electrode coking zone deviates from its prescribed critical value. The latter works only for large-sized electrodes (e.g., at least 200 mm). A third version, which is a combination of the first two, is also possible.

Thus, the proposed device ensures reliable operation of the charge-loading pipe adapted for defining a central opening in a hollow self-baking electrode, creates the prerequisites for producing a quality electrode, cuts down electrode mass requirements by precluding flowing out and electrode breakage, contributes to a saving in electric power, and provides higher furnace efficiency.

Figure 3:
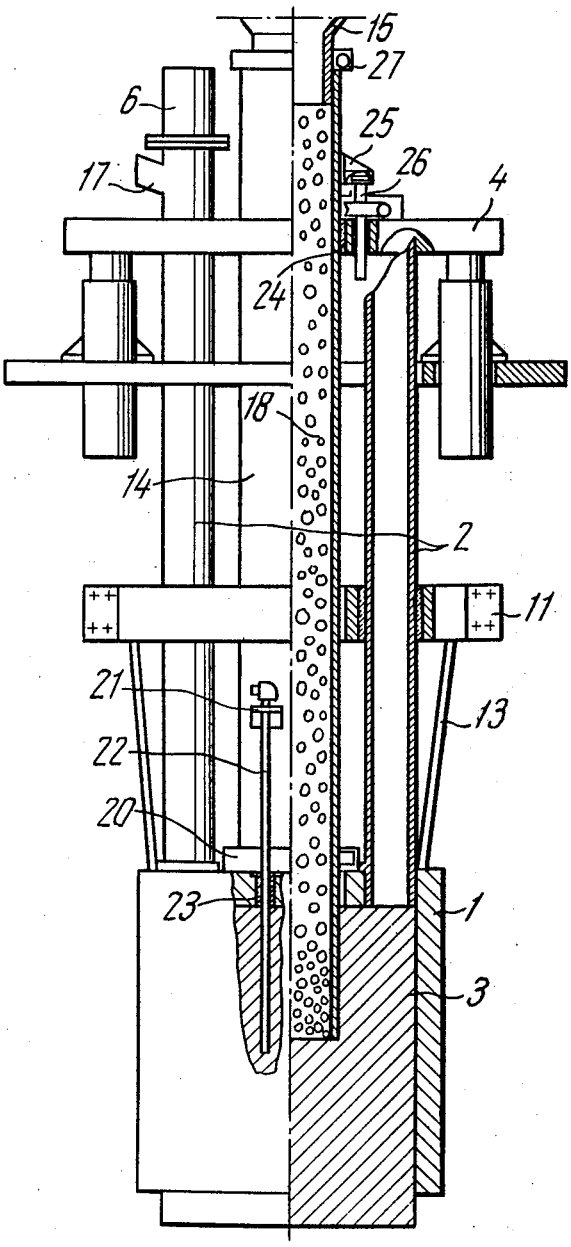
FIG. 3 is a longitudinal, partly in section, view of another embodiment of a device for forming a self-baking solid electrode, according to the invention.

Another embodiment of the device is shown in FIG. 3 is adapted for forming a solid self-baking electrode and comprises a permanent current-carrying mould 1 for manufacturing said solid self-baking electrode 3, mass-feeding pipes 2 having bottom portions communicating with the current-carrying mould 1 and top portions interconnected with the drive means 4 for shifting the electrode 3. The mass-feeding pipes 2 have presses 6 fixed thereon.

A charge-loading pipe 14 is inserted into the current-carrying mould 1 with an insulating packing 20 mounted thereon.

Fastened to the pipe 14 around its circumference are temperature-sensitive elements 22 set up on brackets 21 and inserted with insulating packings 23 inside the current-carrying mould 1 at several points along the height and in the cross-section of the formed solid self-baking electrode 3 in its coking zone.

The top part of the pipe 14 passes through an insulating guide sleeve 24 built in the drive means 4 for shifting an electrode 3 and is interconnected therewith by means of brackets 25 and screw jacks 26.

In this case the pipe 14 is made of a low carbon alloy steel. As, while lowering the electrode, said pipe 14 acts as a pusher of both the electrode unit and its supporting fixtures, the bottom end of said pipe 14 can be made of high-temperature steel to enhance its reliability, since it is immersed into the electrode slightly below its coking zone in a 450° - 500° C. temperature range.

For providing reliable operation and safe servicing of the proposed device, the brackets 21 on which the temperature-sensitive elements 22 are fixed as well as the brackets 25 acting as an interlocking element between the screw jacks 26 are insulated from the pipe 14 with heat-resisting insulation.

The above-outlined device operates in a manner similar to that of the device shown in FIG. 2.

The only difference consists in that the pipe 14 is employed for filling the central part of the solid self-baking electrode 3 with either an electrode mass, similar to that forced by presses 6 into the mass-feeding pipes 2, or use is made of fluxing or alloy additives introduced into said pipe 14 and baked in the electrode mass encompassing said substances, which constituent the central part of a solid self-baking electrode and which, as the electrode is being burnt, take part in melting the charge and obtaining the product of a requisite composition and quality.

Hence, the present invention allows realization of additional technological potentialities and highly important advantages.

Figure 4:
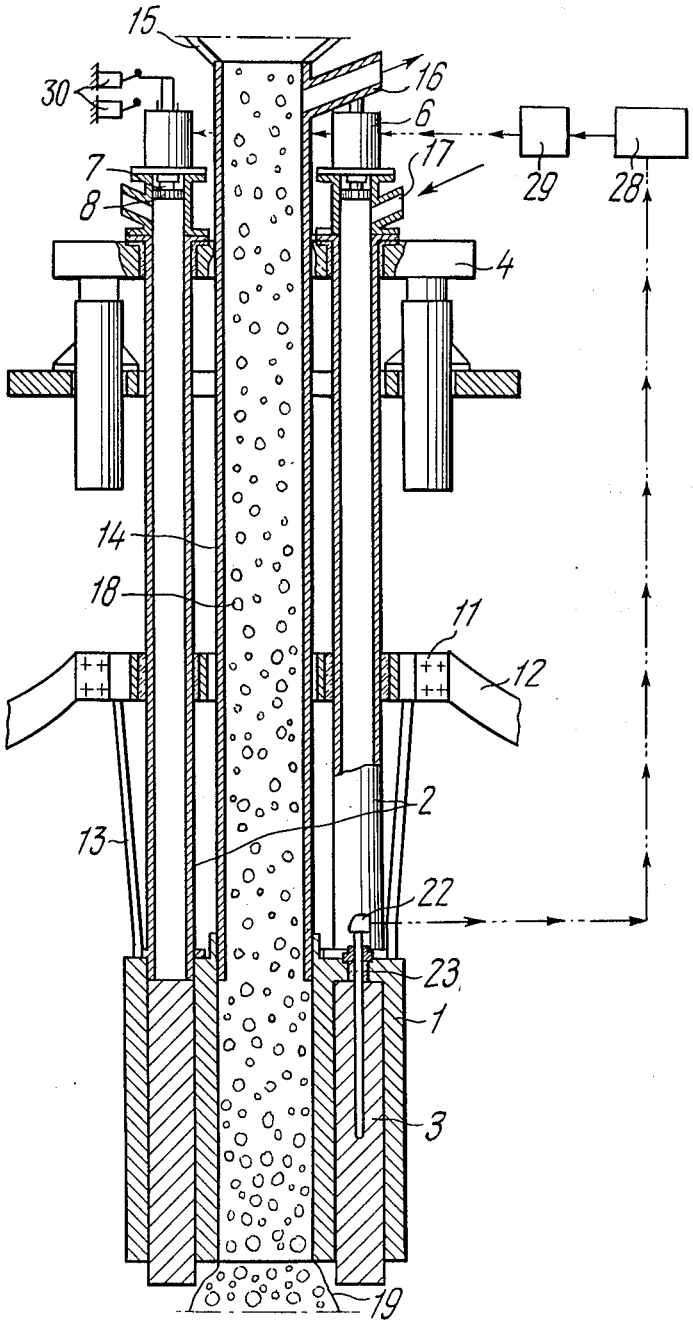
FIG. 4 is a longitudinal, cross sectional view of an embodiment of a device for forming a self-baking electrode, which is equipped with a programming follower, according to the invention.

According to the embodiment shown in FIG. 4, the device comprises a permanent current-carrying mould 1 secured to mass-feeding pipes 2 adapted for forming a hollow self-baking electrode 3. At their top the mass-feeding pipes 2 are fastened to a drive means 4 for shifting the electrode 3. Presses 6, each of which having a connecting rod 7 and a piston 8, are secured to the top part of said mass-feeding pipes 2.

The current-distribution ring 11 of a current lead 12 coupled through water-cooled tubular busbars 13 with the current-carrying mould 1 is also fastened to said pipes 2.

A charge-loading pipe 14 has a bottom portion communicating with the current-carrying mould 1 and a top portion secured to the drive means 4 for shifting the electrode 3. The pipe 14 is also in communication with a hopper 15 and is fitted with a gas offtake 16.

The above device embodiment is equipped with a programming or control system comprising a follow-up unit 28 and an actuating unit 29. The input of the follow-up unit 28 is coupled with temperature-sensitive elements 22 which are set up and fixed with heat-resisting insulating packings 23 on the current-carrying mould 1 and its output is coupled through the actuating unit 29 with the presses 6.

For switching the reciprocating rods 7 and pistons 8 of the presses 6, limit switches 30 are mounted in the extreme top and bottom positions of said rods 7 and pistons 8.

It should be added that since the presses 6 can be made as cylinders using either compressed air or a pressurized liquid or as screw presses with electromechanical drives, the actuating units 29 may constitute accordingly, e.g., a solenoid-operated valve or a slide valve or an appropriate electrical apparatus, such as a contactor.

As for the temperature-sensitive elements 22, they are installed at several points along the circumference and in the cross-section of the hollow self-baking electrode 3 and may constitute, e.g., thermocouples or resistance thermometers.

The follow-up unit 28 can be built, for example, of thyristors, or it can be a standard instrument, e.g., a potentiometer. (see P. N. Manailov, "Heat Engineering Measurements and Automotion of Heat Engineering Processes", Moscow. "Energy" Publishers, 1976, pp. 32 — 32).

The herein-proposed device functions in the following manner.

A charged particle 18 passes from a hopper 15 along the charge-loading pipe 14 into a furnace hearth 19 (bath) directly under electric arcs that are arcing on the end face of said hollow self-baking electrode 3. A hot gas rises from the furnace hearth 19 through the charge-loading pipe 14 and transmits a considerable part of its heat to the charged particle 18, whereupon it is discharged through a gas offtake 16.

Gas flow in an opposite direction (downwards) is also possible, the gas passing in that case through the charge-loading pipe 14 and charged particle 18 which allows utilization of a collected waste furnace gas (e.g., drawn from the gas offtake in a furnace roof) or some other gas, for instance, a natural or inert ones.

The electrode mass, in a solid or liquid state, is fed from a hopper (not shown in FIG. 4) through branch pipes of each press 6, as shown by an arrow in the drawing, by resorting to a known means (such as pipelines, vibration hoses, screw conveyors) first into the mass-feeding pipes 2 and then therealong into the permanent current-carrying mould 1 where a hollow electrode 3 is formed and baked under the effect of an electric current flowing therein through a current conductor 12, current-distribution ring 11 and tubular busbars 13, and by the heat of the furnace hearth (bath).

The temperature-sensitive elements 22 are continuously measuring the temperatures at several points of said hollow self-baking electrode 3 (including its coking zone) and delivering signals to the follow-up unit 28 which operates the presses 6 with the aid of the actuating unit 29. Depending on the command signal of the follow-up unit 28, the signal being in direct relation to the temperature values and to the readings of the temperature-sensitive elements 22 installed in certain locations (points or sections) of a hollow self-baking electrode 3, the presses 6, acting simultaneously or individually (selectively) after certain periods of time (prescribed by the program), compress the electrode mass with the aid of the rods 7 and pistons 8 thus forcing it gradually out of the pipes 2 into the current-carrying mould 1. The baked hollow electrode 3 is squeezed under the pressure of said electrode mass out of said current-carrying mould 1. As soon as the rods 7 of the presses 6 are pressed into their limit extreme positions, the limit switches 30 associated with the programming control system send a signal for rapid lifting of the pistons 8 to be followed by their lowering with a preset speed.

The rate of the entire process of baking an electrode and its squeezing out of the current-carrying mould to compensate for its burning-off, as well as the burning-off of said electrode, can be adjusted by means of the follow-up unit 28, the actuating unit 29 and by subsequent operation of the presses 6 within program-prescribed limits thus ensuring automatically a continuous and simultaneous accomplishment of all the above operations, and, thereby providing the prerequisite for obtaining a hollow self-baking electrode 3 of adequate quality.

Figure 5:
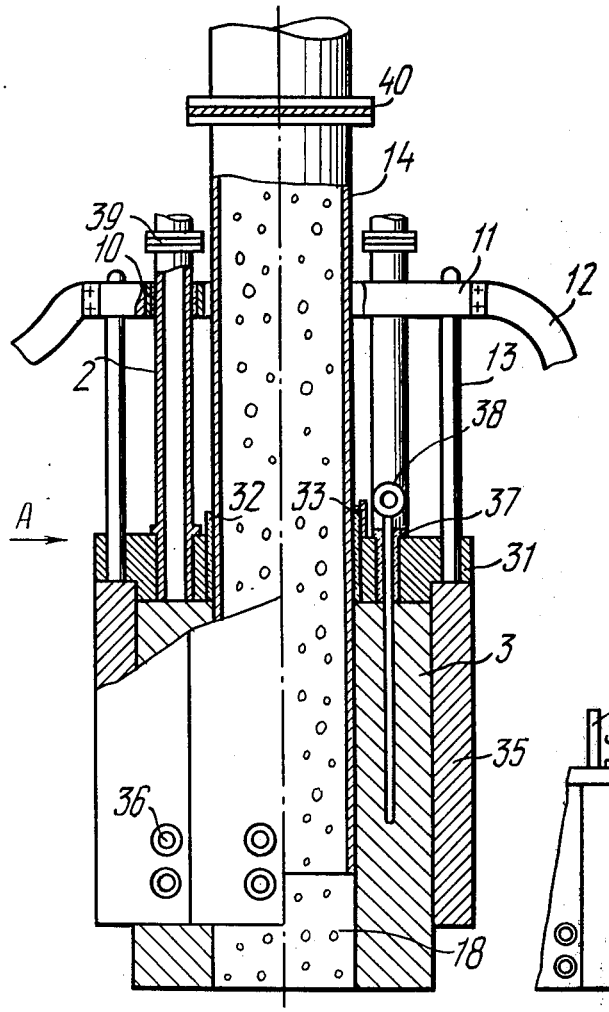
FIG. 5 is a longitudinal, cross sectional view of a permanent current-carrying shell of a device for forming a self-baking hollow electrode, according to the invention.

Another embodiment of the device, presented in FIG. 5, comprises a current-distribution ring 11 fixed with electrical insulation 10 on mass-feeding pipes 2 secured to a connecting ring 31.

Figure 6:
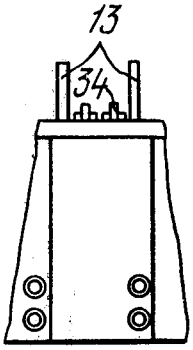
FIG. 6 is a end view of the device shown in FIG. 5 taken in the direction of arrow A.

The connecting ring 31 accommodates an insulating guide sleeve 32 acting simultaneously as a packing and aligned in position by index pins 33 arranged along its circumference and fixed on said ring 31. A charge-loading pipe 14 passes through said guide sleeve 32. Fixed over the circumference of the ring 31 by means of a rapidly-detachable lock joint 34 (FIG. 6), such as, key or screw joints or a combination of said joints (e.g., dowels and keys, dowels and nuts, studs, screws etc.) are water-cooled electric contact plates 35 (FIG. 5) closed on themselves, with all the adjacent plates being interconnected by a lock joint and the bottom parts of said plates 35 being additionally secured to each other by detachable joints, e.g., by screws 36 turned in their bodies. The electric contact plates 35 are made of copper and alloys thereof and are either castings with special ducts for the passage of cooling water or stampings with drilled ducts.

The connecting ring 31 accommodates insulating packings 37 that are mounted at several points along its circumference and through which feelers 38 are introduced into the coking zone of a hollow self-baking electrode 3.

To enable their interlocking with the conjugated furnace elements, the top parts of the mass-feeding pipes 2 and charge-loading pipe 14 are fitted with flanges 39 and 40 accordingly. This assures reliable operation of the proposed device and eliminates electrical-shock fatalities in servicing furnace structural elements mating therewith.

A distinctive feature of the proposed device consists in that its design permits readjustment, modernization, of operations and adequate quality of electrodes 3 by changing their cross-section and by affecting the coking process and electrode transfer for offsetting its burning, — all these measures being a function of the technological process and electrical parameters of the furnace.

The charge-loading pipe 14 and the hole for its passage through the joint ring 31 are readily changeable, in other words, they may have varying (greater or smaller) diameters depending on the peculiarities of the technological process and its electrical characteristics, the other elements of the proposed device being in that case unchanged.

To make things clear, it should be pointed out that a need for readjustment or modernization of the proposed device can arise only if a new production process and electrical parameters of the furnace differ considerably from the preceding ones. In all other cases the device does not require any modifications, insofar as the quality of electrodes can be assured by simpler means envisaged by the inherent design of the device which will be clear from a description that follows.

To increase the effect of a charge-loading pipe 14 on the coking of a hollow electrode 3, it is not made of heat-resistant steel — its usual material, but, instead, its bottom part is provided with a cooling system and is made, for instance, of commercial or heat-resistant iron with a cast-in steel coil along which water, compressed air or a combination (a water-air mixture) is fed, the flowrate of said coolant being adjusted by a conventional valve.

These details, that are evident from the above description, are not shown in FIG. 5.

The quality of a hollow self-baking electrode 3 is monitored by the feelers 38 at regular intervals to adjust in a proper manner the degree of slipping of the electrode to compensate for its burning-off in order to preclude the squeezing of an unbaked electrode out of the mould, flowing out of the electrode mass or electrode breakage.

The herein-proposed device operates in the following manner.

Figure 8:
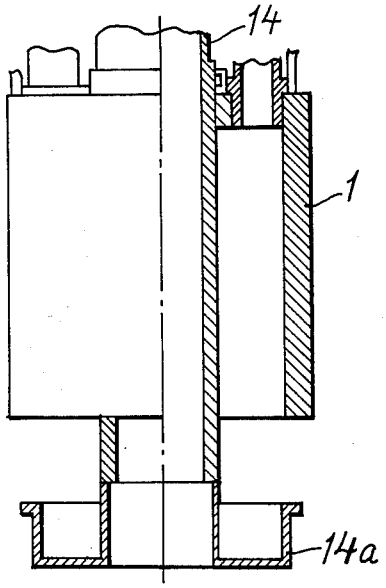
FIG. 8 is a longitudinal, partly in section, view of the embodiment shown in FIG. 2, with the charge loading pipe in its lowest position.

Initially the annular gap between the electric contact plates 35 and the charge-loading pipe 14 is closed by a temporary sheet steel mushroom stopper (similar to that shown in FIGS. 8 and 9, but not shown in FIG. 5) which is welded to the bottom edge of the charge-loading pipe 14 to fit tightly from beneath to the end face planes of said electric contact plates 35.

The electrode mass fed under pressure along the mass feeding pipes 2 fills up the entire section of the formed self-baking electrode 3.

Next, the first batch of charged particle 18 of electrically conductive material, such as, coke, is delivered through the charge-loading pipe 14. The coke fills up the bottom part of said charge-loading pipe 14, closing a circuit for subsequent passage of an electric current which will flow either between the hollow electrode being formed and furnace hearth or between electrodes adjacent to that being formed. Following that, water and power supplys are turned on. Cooling water flows along the tubular busbars 13 of the current-distribution ring 11 into the electric contact plates 35, and the electric current starts flowing from the said ring 11 through the tubular busbar 13, the electric contact plates 35, the mushroom stopper and the coke in the thus defined circuit.

The coke, the mushroom stopper and the electrode mass are heated as a result, which gradually creates the temperature conditions required for forming a self-baking hollow electrode 3. As soon as a electrode coking point of at least 360° to 400° C. is attained, the electrode mass, beginning from the electrode end face and extending upwards over its cross-section, undergoes a transformation of its aggregate state, forming a solid electrically conductive structure. From that moment on, the forming of said electrode structure is monitored at regular intervals by means of the feelers 38 inserted at several points in the cross-section of the hollow electrode 3.

The mushroom stopper burns gradually and completely having performed its functions.

With a steady-state production process, the electrode mass is continuously fed, coked and forces out a baked hollow electrode 3 offsetting its burning-off in the furnace hearth. The charge particles 18 of a prescribed composition are also supplied in a continuous mode.

The gas released in the furnace hearth rises along the charge-loading pipe 14 transmitting its heat to the charged particles 18, and is exhausted thereafter. In this case a downward gas flow is also possible, the gas passing through the charge-loading pipe 14 and the charged particles 18; this enables the use of either a furnace exit gas collected therefrom (e.g., drawn off through the gas offtake in the furnace roof) or of some other gas.

Industrial effectiveness of the proposed device is determined by the need for electric furnaces with devices for forming self-baking hollow electrodes without casings, which are required primarily for producing aluminium-silicon, silicon, metal manganese, calcium carbide, etc., where the iron of the electrode casing of a conventional self-baking electrode is a harmful admixture.

Figure 7:
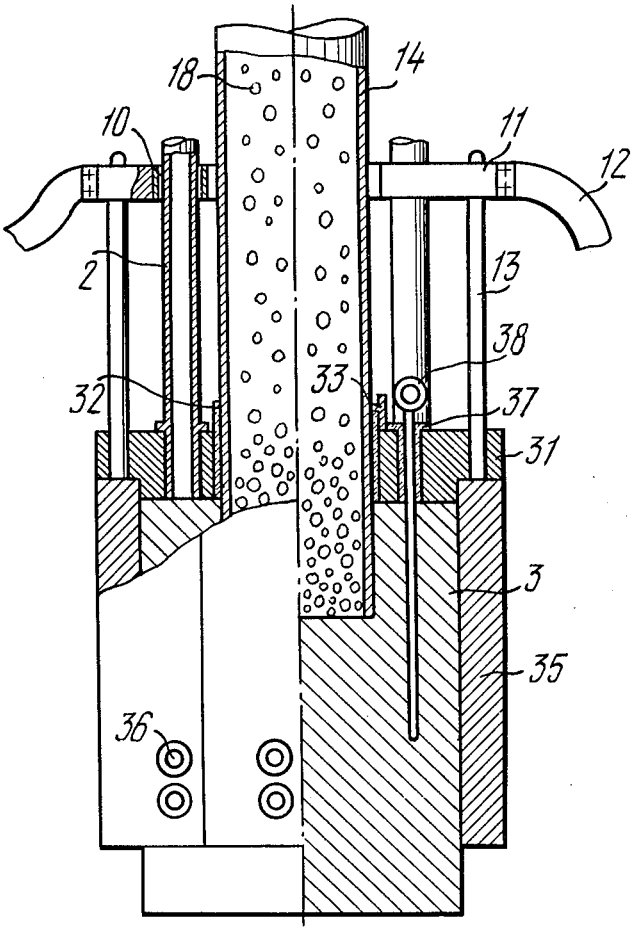
FIG. 7 is a longitudinal, crosssectional view of a permanent current-carrying mould of a device for forming a self-baking solid electrode, according to the invention.

According to the embodiment shown in FIG. 7 the device for forming a solid self-baking electrode is similar to that presented in FIG. 5 and comprises a current-distribution ring 11 fixed with electric insulation 10 on mass-feeding pipes 2 secured to a connecting ring 31.

The connecting ring 31 accommodates an insulating guide sleeve 32 acting as a packing and being aligned in position by index pins 33 set up along its circumference and fixed on said ring 31.

A charge-loading pipe 14 passes through the guide sleeve 32.

Fastened by means of a lock joint along the periphery of said ring 31 are electric contact plates 35, each of which is interlocked with the adjacent one by the lock joint, the bottom part of said plates being additionally interconnected by means of detachable joints, such as screws 36 turned in their bodies.

The electric contact plates 35 are made of copper or alloys thereof and are either castings with conduits for cooling water or stampings with drilled conduits.

The connecting ring 31 incorporates insulating packings 37 set up at several points along its circumference with feelers 38 passing through said packings 37 into the coking zone of said solid self-baking electrode 3.

The above-outlined device functions in a manner similar to that of the device shown in FIG. 5, the only difference being in that the charge-loading pipe 14 is either employed for charging into the central part of the solid self-baking electrode 3 an electrode mass similar to that supplied along mass-feeding pipes 2 or for loading fluxing and alloy additives, which on being baked in the surrounding electrode mass form the central part — a core — of said solid self-baking electrode structure and are consumed together with the electrode during its burning-off, being melted together with the charged particles and contributing to the manufacture of a final product of the requisite composition and quality.

This assures additional vital technological potentialities and advantages.

What we claim is:

1. A method of forming a self-baking electrode, comprising the steps of: feeding an electrode mass into a mass-feeding passage during melting in an electric furnace; charging said electrode mass; forcing said electrode mass out of said mass-feeding passage and supplying it into a permanent current-carrying mold, in accordance with data obtained by continuous measuring of temperature of the electrode being formed at several points along its height and in its cross-section, at a rate which is proportional to that of coking, shifting and burning-off of said electrode; coking said electrode mass and transforming it into a solid structure; and squeezing the electrode out of said mold as it is being coked and burnt.

2. A method of claim 1, further comprising the step of feeding said electrode mass into the coking zone by alternating its operation mode to prevent irregular roasting of the electrode.

3. A method of claim 1, further comprising the step of introducing fluxing alloy additives into the electrode mass while forming the self-baking electrode.

4. A device for forming a self-baking electrode, comprising; a permanent current-carrying mold for forming and baking said electrode;

a mass-feeding passage, for feeding electrode mass, communicating with said permanent current-carrying mold;

a drive means, for shifting the electrode being formed, coupled to a side surface of a top part of said mass feeding passages with electrical insulation;

presses coupled with electrical insulation to a top surface of the top part of said mass-feeding passages;

a current distribution ring coupled with heat and electrical insulation to said mass-feeding passages;

a current lead from a power supply coupled to said current distribution ring;

water-cooled tubular busbars through which said current distribution ring is coupled with said permanent current-carrying mold;

a charge-loading means having a top part secured to said drive means and a bottom part communicating with said permanent current-carrying mold and around which said mass-feeding pipes are arranged, said part of said charge-loading means being fitted with a gas offtake; and thermoelements for measuring the temperature of said electrode being formed.

5. A device of claim 4 for forming a self-baking electrode, wherein;

temperature-sensitive elements are employed as said thermo-elements, embedded in the electrode mass and mounted on said charge-loading means; and said charge-loading means is provided with a drive means associated with said temperature-sensitive elements.

6. A device of claim 5, further comprising a programming control unit, which consists of:

a follow-up unit having an input coupled to said temperature-sensitive elements; and at least one actuating unit having an inlet connected to the output of said follow-up unit and an outlet coupled to said presses.

7. A device of claim 4, further comprising:

a connecting ring fastened to said mass-feeding passages;

water-cooled electric contact elements connected by a lock joint to said connecting ring, interconnected to each other by aid of lock joints and being detachable;

an insulating guide sleeve through which said charge-loading passage is introduced into said permanent current-carrying mold, said guide sleeve simultaneously acting as a packing; and feelers employed as said thermoelements, introduced periodically into the electrode coking zone inside said current-carrying mold with insulating packings, and set up in said connecting ring at several points along the circumference and in the cross-section of said electrode being formed.

8. A device of claim 4, wherein said charge-loading passage is cooled, a bottom part of said passage being fitted with internal conduits for the passage of a cooling mixture and with a means for adjusting the flowrate of said cooling mixture.

* * * * *